US005708927A

United States Patent [19]

Etoh

[11] Patent Number: 5,708,927

[45] Date of Patent: Jan. 13, 1998

[54] DRIVING MECHANISM FOR A FIXING APPARATUS HAVING AN IDLE GEAR DISENGAGEABLE FROM A FIXING ROLLER GEAR BY GRAVITY

[75] Inventor: Shinji Etoh, Ebina, Japan

[73] Assignee: Ricoh Company, Ltd., Tokyo, Japan

[21] Appl. No.: 716,523

[22] Filed: Sep. 19, 1996

[30] Foreign Application Priority Data

Sep. 20, 1995 [JP] Japan ..... 7-241705

[51] Int. Cl.[6] ..... G03G 21/16

[52] U.S. Cl. ..... 399/122; 399/124

[58] Field of Search ..... 399/122, 124, 399/400, 320

[56] References Cited

U.S. PATENT DOCUMENTS

| | | | |
|---|---|---|---|
| 4,421,401 | 12/1983 | Kagiura et al. | 399/122 |
| 4,443,101 | 4/1984 | Sakurai et al. | 399/124 X |
| 4,674,859 | 6/1987 | Iseki et al. | 399/122 |
| 5,301,000 | 4/1994 | Heigl | 399/122 |

FOREIGN PATENT DOCUMENTS

| | | |
|---|---|---|
| 63-139253 | 9/1988 | Japan . |
| 3-14666 | 2/1991 | Japan . |
| 4-107491 | 4/1992 | Japan . |
| 4-311983 | 11/1992 | Japan . |

*Primary Examiner*—Nestor R. Ramirez

*Attorney, Agent, or Firm*—Oblon, Spivak, McClelland, Maier & Neustadt, P.C.

[57] ABSTRACT

A driving mechanism for a fixing apparatus which has an idle gear disengageable from a gear rotating a fixing roller without cooperation of an opening operation of a panel provided to the fixing apparatus. A fixing gear is connected to a fixing roller. A drive gear provides a rotational force. An idle gear is provided between the drive gear and the fixing gear to transmit the rotational force from the drive gear to the fixing gear. The idle gear is always engaged with the drive gear. A pivot member is pivotable with respect to a pivot member shaft between a first position and a second position below the first position. The idle gear is engaged with the fixing gear when the pivot member is at the first position. The idle gear is moved downwardly by gravity and thereby disengaged from the fixing gear when the pivot member is at the second position. Thus, there is no need to provide a moving mechanism to disengage the idle gear from the fixing gear. The fixing roller can be manually rotated since there is no load applied by the drive gear.

10 Claims, 3 Drawing Sheets

DRIVING MECHANISM FOR A FIXING APPARATUS HAVING AN IDLE GEAR DISENGAGEABLE FROM A FIXING ROLLER GEAR BY GRAVITY

BACKGROUND OF THE INVENTION

1. Field of the Invention

The present invention relates to a driving mechanism for driving a fixing roller used in a copy machine, a facsimile machine or a printer, and more particularly to a driving mechanism having an idle gear transmitting a driving force from a motor to the fixing roller.

2. Description of the Related Art

A description will now be given, with reference to FIG. 1, of a conventional fixing apparatus used in a copy machine. FIG. 1 is an illustration of a copy machine using a conventional fixing apparatus having a driving mechanism for driving a fixing roller 1.

In the copy machine shown in FIG. 1, a print paper or sheet is supplied to a photosensitive drum 6 through register rollers 7. The print paper passes between the photosensitive drum 6 and a transfer charger 8 so that a toner image formed on the photosensitive drum 6 is transferred onto the print paper. Then, the print paper is passed through a separation charger 9 so as to be separated from the photosensitive drum 9. The transfer charger 8 and the separation charger 9 are mounted on a conveyance guide member 10 which is pivotable about a support shaft 18. When a copying operation is performed, the conveyance guide member 10 is positioned at an upper position so that the transfer charger is positioned adjacent to a surface of the photosensitive drum 6. The conveyance guide member 10 is pivoted downwardly as indicated by an arrow A in the figure when a maintenance operation is performed such as removing a jamming paper so that the jamming paper is accessible.

The print paper separated from the photosensitive drum 6 is guided by the conveyance guide member 10, and is supplied to a position between the fixing roller 1 and a pressing roller 3 which presses the print paper to the fixing roller 1. The fixing roller 1 is rotatable about a support shaft 12. After the toner image on the print paper is fixed by a heat applied by the fixing roller 1, the print paper is separated from the fixing roller 1 by a separation claw 4, and is ejected from the fixing apparatus by an eject roller 5.

The driving mechanism which is illustrated in FIGS. 2 and 3 is provided on the back side of the fixing apparatus. Since the illustration of FIG. 1 is viewed from the front side, the driving mechanism is provided beyond the fixing roller 1 and the pressing roller 3.

The driving mechanism for the fixing roller 1 generally comprises a fixing gear 31 for driving the fixing roller 1, a drive gear 33 which is rotated by a motor and an idle gear 36 for transmitting a drive force from the drive gear 33 to the fixing gear 31. The fixing gear 31 is mounted to an end of the support shaft 12 which is a rotational shaft of the fixing roller 1. The driving gear 33 is rotatably supported by a shaft 34, and the idle gear 36 is rotatably supported by a shaft 37. The shaft 37 is supported by a bracket 35 which is pivotally supported at one end by the shaft 34 of the drive gear 33 as illustrated in FIG. 3. A leaf spring 38 extends in a direction opposite to the drive gear 33. An extreme end of the leaf spring 38 abuts against a stopper 43 so that the bracket 35 and thus the idle gear 36 is pressed in a direction toward the fixing gear 31 when the fixing apparatus is set in an operable state.

An opposite end of the bracket 35 is engaged with a lever 39 which is fixed to a connecting rod 41. The connecting rod 41 extends from the rear side to the front side of the fixing apparatus, as illustrated in FIG. 2, so that the connecting rod 41 is rotated when a front cover 45 of a front panel 40 of the copy machine is opened. The connecting rod 41 is connected to a link mechanism having a lever 44 which is moved by an opening and closing of the front cover 45.

More specifically, when the front cover 45 is opened, the connecting rod 41 is rotated in a direction indicated by an arrow B in FIG. 2. The rotation of the connecting rod 41 causes the lever 39 to be rotated in a direction indicated by an arrow B in FIG. 3 due to a pulling force generated by a spring 42. Since an end of the lever 39 presses the end of the bracket 35 in the direction B of FIG. 3, the bracket 35 is pivoted about the shaft 34 in the direction B. This movement of the bracket 35 causes the idle gear 36 to be disengaged from the fixing gear 31. Thus, the fixing roller 1 connected to the fixing gear 32 can be freely rotated by rotating a knob (not shown in the figures) in either direction to remove, for example, a print paper jammed in the fixing apparatus.

After a maintenance operation is completed, the front cover 45 is closed. When the front cover 45 is closed, a protruding stub 46 protruding from an inner surface of the front cover 45 acts on a link mechanism connected to the connecting rod 41 so as to rotate the connecting rod 41 in a direction indicated by an arrow C in FIG. 2. This rotation of the connecting rod 41 causes the lever 39 to be rotated in a direction indicated by an arrow C in FIG. 3. This results in the bracket 35 pivoting about the shaft 34 due to a pressing force of the leaf spring 38. Accordingly, the idle gear 36 mounted on the bracket 35 engages with the fixing gear 31. Thus, a rotational force of the drive gear 33 is transmitted to the fixing gear 31 via the idle gear 36. In this state, the fixing roller 1 connected to the fixing gear 31 is rotated by a rotational force of the driving gear 33 via the idle gear 36. Thus, the fixing apparatus can perform a regular fixing operation.

As mentioned above, in the conventional fixing apparatus, the idle gear 36 is moved by an opening action of the front panel 45 via the link mechanism. Since the link mechanism is complex and the connecting rod has to be extended from the rear side to the front side within the interior of the copy machine, a manufacturing cost of the driving mechanism of the fixing apparatus is increased and reliability thereof is also decreased. Additionally, there is another problem in that the bracket 35 has to be accurately positioned by a stopper mechanism so that the idle gear 36 is properly engaged with both the drive gear 33 and the fixing gear 31.

SUMMARY OF THE INVENTION

It is a general object of the present invention to provide an improved and useful driving mechanism for a fixing apparatus in which the above-mentioned problems are eliminated.

A more specific object of the present invention is to provide a driving mechanism for a fixing apparatus which has a simple structure with a high reliability.

Another object of the present invention is to provide a driving mechanism for a fixing apparatus which does not require an accurate positioning of an idle gear transmitting a drive force to a fixing roller.

Further object of the present invention is to provide a driving mechanism for a fixing apparatus which has an idle gear disengageable from a gear rotating a fixing roller without cooperation of an opening operation of a panel provided to the fixing apparatus.

In order to achieve the above-mentioned objects, there is provided according to the present invention a driving mechanism for a fixing apparatus for fixing an image on a print sheet by a fixing roller, the driving mechanism comprising:

a fixing gear connected to the fixing roller;

a drive gear for providing a rotational force;

an idle gear provided between the drive gear and the fixing gear for transmitting the rotational force from the drive gear to the fixing gear, the idle gear being always engaged with the drive gear; and a pivot member pivotable with respect to a pivot member shaft between a first position and a second position below the first position, the idle gear being engaged with the fixing gear when the pivot member is at the first position, the idle gear being moved downwardly by gravity and thereby disengaged from the fixing gear when the pivot member is at the second position.

According to the above-mentioned invention, the idle gear is disengaged from the fixing gear by its own weight when the pivot member is moved to the second position which is below the first position. Thus, there is no need to provide a moving mechanism to disengage the idle gear from the fixing gear. The fixing roller can be manually rotated since there is no load applied by the drive gear.

In one embodiment according to the present invention, the pivot member may comprise a guiding member for guiding the print sheet toward the fixing apparatus. Additionally, the guiding member may carry a transfer charger for transferring the image to be fixed on the print sheet prior to a fixing operation, the transfer charger being positioned adjacent to a photosensitive drum when the pivot member is at the first position, the transfer charger being spaced apart from the photosensitive drum when the pivot member is at the second position. Accordingly, the guiding member which is provided in a conventional apparatus such as a copy machine is commonly used as the pivot member. This results in reduction in the number of parts of the copy machine.

Additionally, the driving mechanism according to the present invention may further comprise a bracket for supporting the idle gear, the bracket being pivotable with respect to a drive gear shaft supporting the drive gear.

In one embodiment according to the present invention, the bracket may be pivotable between a first stop position and a second stop position below the first stop position, the bracket being supported at a third stop position between the first stop position and the second stop position when the pivot member is at the first position, the idle gear being incompletely engaged with the fixing gear when the bracket is at the third stop position, the idle gear being moved toward a completely engaged position by cooperation of a rotational force of the idle gear and a load applied by the fixing gear.

The driving mechanism according to the present invention may further comprise an acting member, provided on the pivot member, for contacting the bracket when the pivot member is at the first position, the bracket being supported at the third stop position by the acting member from underneath the bracket. The acting member may be formed of an elastic material so that the bracket is elastically supported at the third stop position.

According to this invention, since the bracket is elastically supported by the acting member, the idle gear is disengageable from the fixing gear when the fixing roller is rotated manually in the eject direction of the print sheet.

Additionally, in one embodiment according to the present invention, the bracket may have a notch having a first inner edge and a second inner edge opposite to the first inner edge, the pivot member shaft extending through the notch so that the first stop position is defined by the first inner edge of the notch abutting against the pivot member shaft and the second stop position is defined by the second inner edge of the notch abutting against the pivot member shaft.

In this invention, the pivot member shaft and the first and second inner edges of the notch formed on the bracket serve as stopper mechanism to limit the pivotal movement of the bracket. Thus, there is no need to provide a separate stopper mechanism.

Additionally, in one embodiment according to the present invention, center axes of the fixing gear, the idle gear and the drive gear are aligned substantially along a straight line. Preferably, the center axes of the fixing gear, the idle gear and the drive gear are aligned substantially along a horizontal line. This structure ensures the idle gear being disengaged from the fixing gear by gravity.

Other objects, features and advantages of the present invention will become more apparent from the following detailed description when read in conjunction with the accompanying drawings.

DETAILED DESCRIPTION OF THE PREFERRED EMBODIMENT

Figure 1:
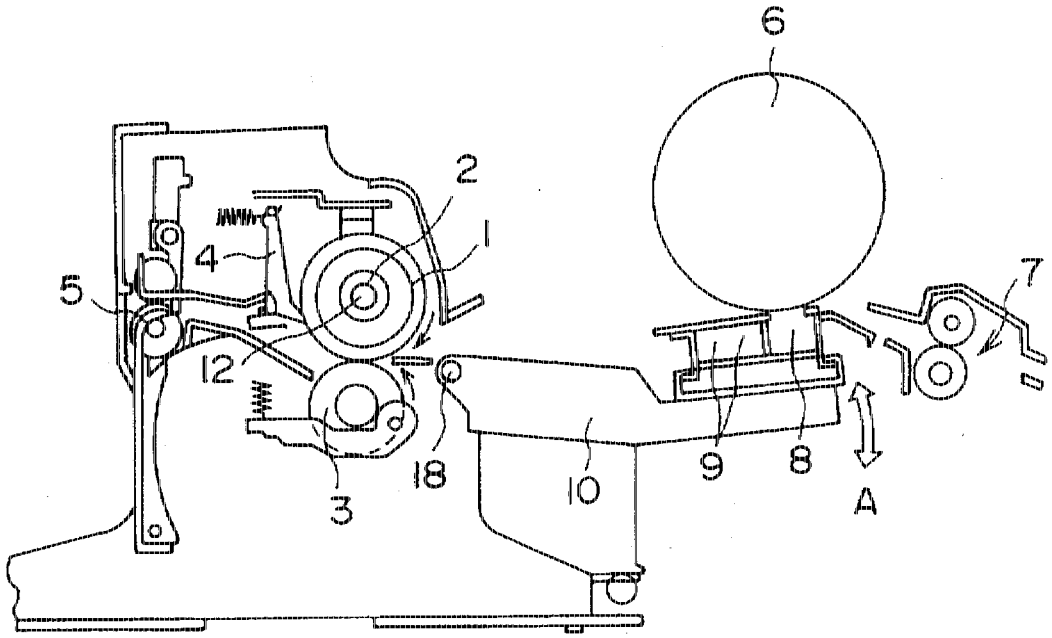
FIG. 1 PRIOR ART
FIG. 1 is an illustration of a copy machine using a conventional fixing apparatus having a driving mechanism for driving a fixing roller.
Figure 2:
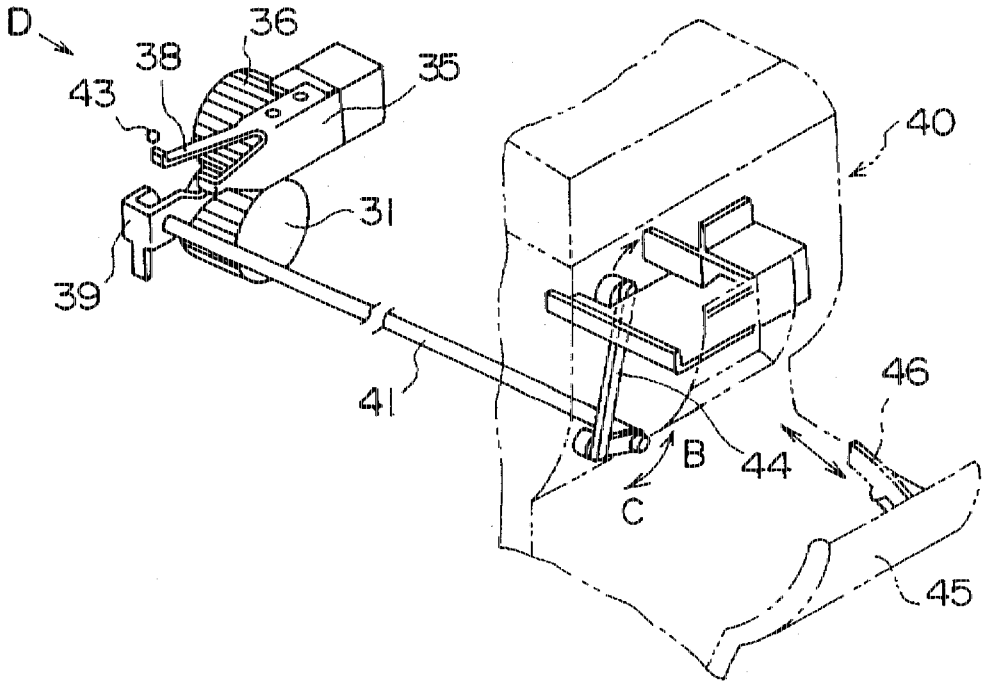
FIG. 2 PRIOR ART
FIG. 2 is a perspective view of the driving mechanism provided in the conventional copy machine shown in FIG. 1.
Figure 3:
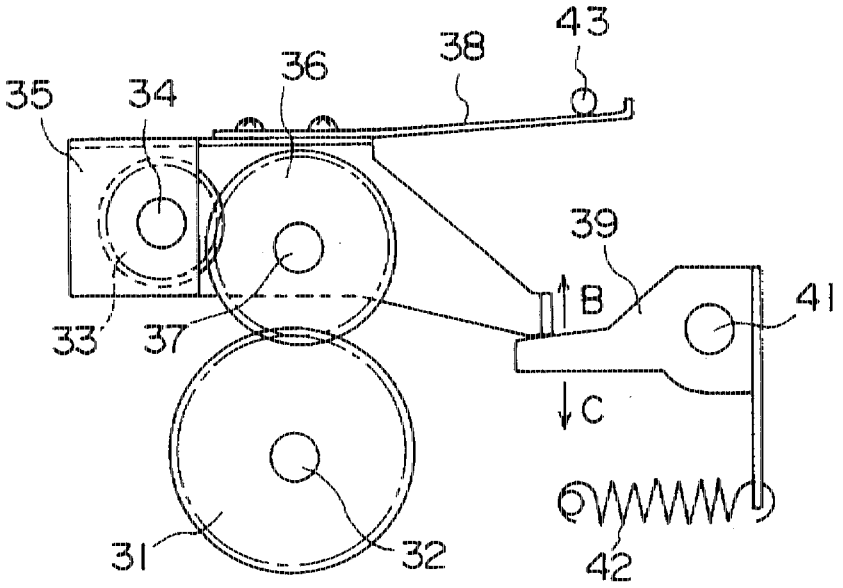
FIG. 3 PRIOR ART
FIG. 3 is a side view of the driving mechanism shown in FIG. 2 viewed from a direction indicated by an arrow D in FIG. 2.
Figure 4:
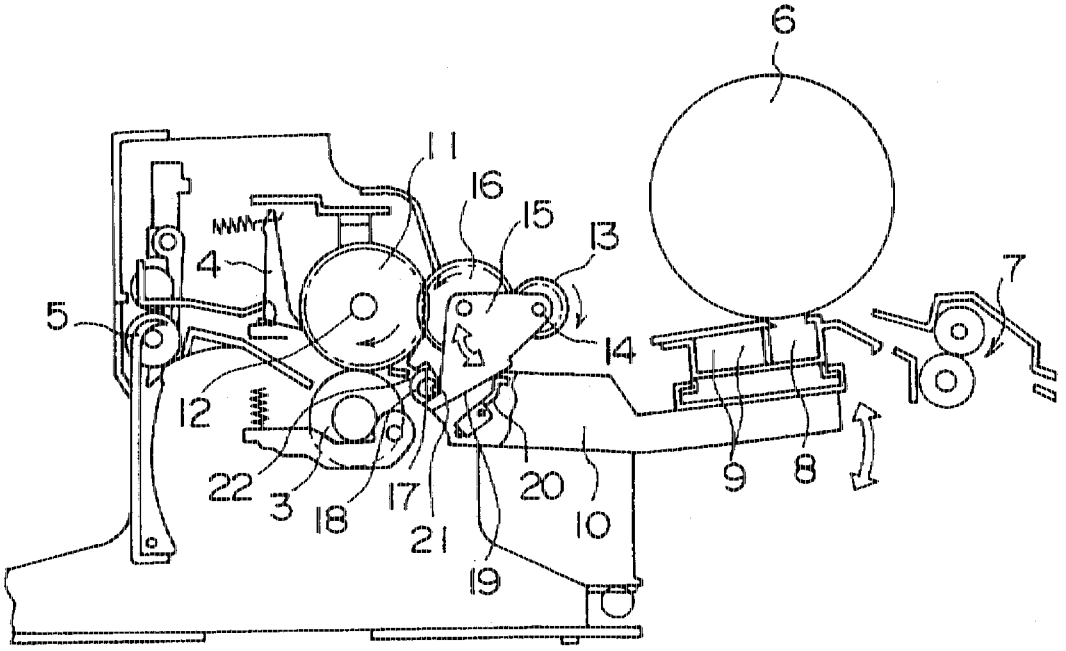
FIG. 4 is an illustration of a copy machine using a fixing apparatus having a driving mechanism according to a first embodiment of the present invention.
Figure 5:
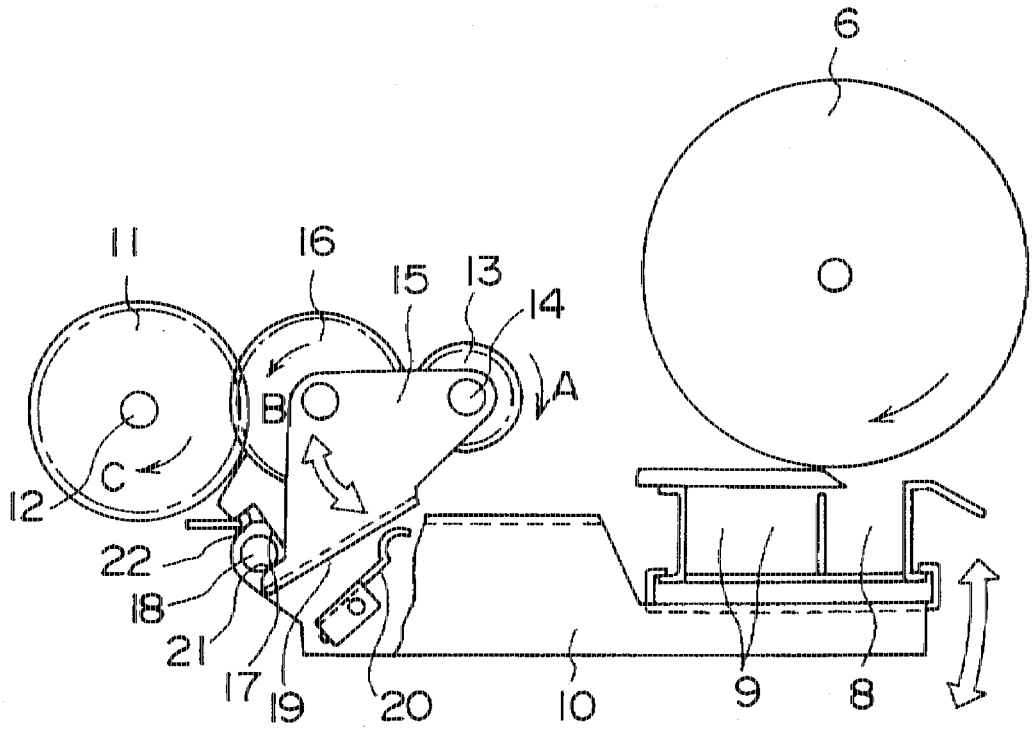
FIG. 5 is an enlarged view of a part of the copy machine related to the driving mechanism shown in FIG. 4.

A description will now be given, with reference to FIGS. 4 and 5, of a first embodiment according to the present invention. FIG. 4 is an illustration of a copy machine using a fixing apparatus having a driving mechanism according to the first embodiment of the present invention in a state where the fixing roller 1 is removed. FIG. 5 is an enlarged view of a part of the copy machine related to the driving mechanism shown in FIG. 4. In FIGS. 4 and 5, parts that are the same as the parts shown in FIG. 1 are given the same reference numerals, and descriptions thereof will be omitted.

The driving mechanism according to the present embodiment includes a fixing gear 11 which corresponds to the fixing gear 31, an idle gear 16 which corresponds to the idle gear 36 and a drive gear 13 which corresponds to the drive gear 33. The fixing gear 11 is fixed to the shaft 12 so as to rotate the fixing roller 1. The drive gear 13 is supported by a shaft 14 which is rotatably supported by a bracket 15. The idle gear 16 is also rotatably supported by a shaft mounted to the bracket 15.

The bracket 15 is formed in a channel shape so that the idle gear 16 and the drive gear 13 are interposed between opposite walls of the bracket 15. The bracket is pivotable about the shaft 14 as shown in bold arrows in the figures. The bracket 15 has a notch 17 in which the support shaft 18 of the conveyance guide member 10 is positioned so that the pivotal motion of the bracket 15 is limited by the support shaft 18. That is, the support shaft 18 serves as a stopper of the bracket. More specifically, the downward pivotal motion of the bracket 15 is limited when an inner edge 22 of the notch 17 abuts against the support shaft 18. On the other hand, the upward pivotal motion of the bracket 15 is limited when an inner edge 21 of the notch 17 opposite to the inner edge 22 abuts against the support shaft 18.

In the present embodiment, an acting member 20 is provided on the conveyance guide member 10. The acting member 20 is formed by an elastic material such as a metal plate so as to elastically support the bracket 15 when the driving mechanism is not operated. It should be noted that FIG. 5 illustrates a state where the driving mechanism is operated. In the operated state, an upward force is exerted on the idle gear 16 due to a rotational force of the drive gear 13. Thus, in the operation state, the bracket 15 is moved upwardly, and a surface 19 of the bracket 15 is separated from the acting member 20 as shown in FIG. 5.

A more detailed description will now be given of the operation of the driving mechanism in connection with a copying operation.

When a copying operation is performed the fixing apparatus is set in an operational state as shown in FIG. 5. That is, the conveyance guide member 10 is pivoted upwardly to a position where the transfer charger 8 is adjacent to the photosensitive drum 6. In this state, when the drive gear 13 is not rotated, the surface 19 of the bracket 15 is pressed by the acting member 20. The pressing force of the acting member is set to be small so that merely a tip of a tooth of the idle gear 16 engages with the fixing gear 11. That is, the engagement of the idle gear 16 and the fixing gear 11 is shallow, and the two gears do not completely engage at pitch circles. In this state, the bracket 15 is positioned where the support shaft 18 is separated from either the inner edge 21 or 22. Accordingly, accurate dimensions and positioning are not required for the parts of the driving mechanism since the idle gear 16 can be roughly engaged with the fixing gear 11.

When the drive gear 13 is rotated in a direction indicated by an arrow A of FIG. 5 in the above-mentioned operable state, the idle gear 16 is moved upwardly due to a rotational force transmitted by the drive gear 16 and the load of the fixing gear 11. Thus, the bracket 15 is pivoted upwardly until the inner edge 21 of the notch 17 abuts against the support shaft 18. In this state, the drive gear 13, the idle gear 16 and the fixing gear 11 are aligned substantially along a straight line, and the idle gear 16 is completely engaged with the fixing gear 11. Thus, the fixing roller 1 which is integral with the fixing gear 11 is rotated in a direction indicated by an arrow C by the rotational force provided by the drive gear 13 via the idle gear 16 which is rotated in a direction indicated by an arrow B in FIG. 5. Accordingly, a print paper or sheet guided by the conveyance guide member 10 is lead between the pressing roller 3 and the fixing roller 1 so that a toner image transferred on the print paper is fixed by the fixing roller 1.

Now, it is assumed that a print paper is jammed adjacent to the fixing roller 1. In such a case, the rotation of the drive gear 13 is stopped. This causes the idle gear 16 to be moved to the above-mentioned position where the idle gear 16 incompletely or partially engages with the fixing gear 11. In this state the fixing roller 1 can be rotated in the direction C by rotating a knob (not shown in figures) connected to the fixing roller 1. That is, when the rotational force is applied to the fixing roller 1, a downward force is exerted on the idle gear 16 due to the rotational force in the direction B and a load of the drive gear 13. This downward force causes pivoting of the bracket 15 in a downward direction. Since the bracket 15 is elastically supported by the acting member 20 by a small pressing force, the bracket 15 can be moved so that a tip of each tooth of the fixing gear 11 overpasses the partially engaged tooth of the idle gear 16. Accordingly, the fixing roller 11 can be manually rotated in the eject direction (direction C) by rotating the knob with a small force so as to forcibly eject a paper which may be jammed in the fixing apparatus.

As mentioned above, since the pressing force of the acting member 20 is set to such a small level that only the weight of the bracket 15 and the idle gear 16 is supported, the teeth of the fixing gear 11 overpasses the teeth of the idle gear 16 when the fixing roller 1 is rotated in the eject direction. Thus, there is no need to completely disengage the idle gear 16 from the fixing gear 11 when the ejection of the print paper is performed.

On the other hand, if a situation occurs in which a jammed print paper must be removed in a direction opposite to the eject direction, the fixing roller 1 must be rotated in the reverse direction. Such a situation occurs when the print paper is jammed at the separation claw 4 or the print paper is wound around the fixing roller 1. In this case, the conveyance guide member 10 is pivoted downwardly so that the transfer charger 8 is spaced apart from the photosensitive drum 6.

When the conveyance guide member 10 is pivoted downwardly, the acting member 20 is also moved downwardly. Thus, the bracket 15 is pivoted downwardly due to its own weight until the inner edge 22 of the notch 17 abuts against the support shaft 18. In this state, the idle gear 16 is completely disengaged from the fixing gear 11. Thus, the fixing roller 1 is freely rotated in either direction by manually rotating the knob connected to the fixing roller 1. Thus, the print paper jammed in the fixing apparatus can be removed by rotating the fixing roller 1 in the reverse direction.

After the paper jam is eliminated, the conveyance guide member 10 is pivoted upwardly so as to return to the operable state to perform a copying operation. Thus, the bracket 15 is moved upwardly by the acting member 20 so that the idle gear 16 roughly engages with the fixing gear 11. Then, when the drive gear 13 is rotated, the idle gear 16 completely engages with the fixing gear as previously discussed to perform a fixing operation.

In the driving mechanism according to the present invention, the drive gears 13, the idle gear 16 and the fixing gear 11 are preferably aligned in a straight line so as to reduce a required accuracy of positioning of the gears and a required accuracy in dimensions of the gears. The line along which the gears are arranged preferably extends in a horizontal direction. However, the line may be inclined as long as the idle gear can be moved downwardly by gravity.

The present invention is not limited to the specifically disclosed embodiments, and variations and modifications may be made without departing from the scope of the present invention.

What is claimed is:

1. A driving mechanism for a fixing apparatus for fixing an image on a print sheet by a fixing roller, said driving mechanism comprising:

a fixing gear connected to said fixing roller;

a drive gear for providing a rotational force;

an idle gear provided between said drive gear and said fixing gear for transmitting the rotational force from said drive gear to said fixing gear, said idle gear being always engaged with said drive gear; and a pivot member pivotable with respect to a pivot member shaft between a first position and a second position below said first position, said idle gear being engaged with said fixing gear when said pivot member is at said first position, said idle gear being moved downwardly by gravity and thereby disengaged from said fixing gear when said pivot member is at said second position.

2. The driving mechanism as claimed in claim 1, wherein said pivot member comprises a guiding member for guiding the print sheet toward said fixing apparatus.

3. The driving mechanism as claimed in claim 2, wherein said guiding member carries a transfer charger for transferring the image to be fixed on the print sheet prior to a fixing operation, said transfer charger being positioned adjacent to a photosensitive drum when said pivot member is at said first position, said transfer charger being spaced apart from said photosensitive drum when said pivot member is at said second position.

4. The driving mechanism as claimed in claim 1, further comprising a bracket for supporting said idle gear, said bracket being pivotable with respect to a drive gear shaft supporting said drive gear.

5. The driving mechanism as claimed in claim 4, wherein said bracket is pivotable between a first stop position and a second stop position below said first stop position, said bracket being supported at a third stop position between said first stop position and said second stop position when said pivot member is at said first position, said idle gear being incompletely engaged with said fixing gear when said bracket is at said third stop position, said idle gear being moved toward a completely engaged position by cooperation of a rotational force of said idle gear and a load applied by said fixing gear.

6. The driving mechanism as claimed in claim 5, further comprising an acting member, provided on said pivot member, for contacting said bracket when said pivot member is at said first position, said bracket being supported at said third stop position by said acting member from underneath said bracket.

7. The driving mechanism as claimed in claim 6, wherein said acting member is formed of an elastic material so that said bracket is elastically supported at said third stop position.

8. The driving mechanism as claimed in claim 4, wherein said bracket has a notch having a first inner edge and a second inner edge opposite to said first inner edge, said pivot member shaft extending through said notch so that said first stop position is defined by said first inner edge of said notch abutting against said pivot member shaft and said second stop position is defined by said second inner edge of said notch abutting against said pivot member shaft.

9. The driving mechanism as claimed in claim 1, wherein center axes of said fixing gear, said idle gear and said drive gear are aligned substantially along a straight line.

10. The driving mechanism as claimed in claim 1, wherein center axes of said fixing gear, said idle gear and said drive gear are aligned substantially along a horizontal line.

* * * * *